US007176866B2

(12) United States Patent
Teraishi

(10) Patent No.: US 7,176,866 B2
(45) Date of Patent: Feb. 13, 2007

(54) DRIVING CIRCUIT OF DISPLAY DEVICE AND METHOD OF DRIVING SAME

(75) Inventor: Toshio Teraishi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 491 days.

(21) Appl. No.: 10/766,192

(22) Filed: Jan. 29, 2004

(65) Prior Publication Data

US 2005/0083278 A1 Apr. 21, 2005

(30) Foreign Application Priority Data

Oct. 16, 2003 (JP) ..... 2003-356754

(51) Int. Cl.
*G09G 3/36* (2006.01)

(52) U.S. Cl. ..... 345/87; 345/204

(58) Field of Classification Search ..... 345/87–99, 345/204–205, 208–211, 214; 349/33–34, 349/37

See application file for complete search history.

(56) References Cited

U.S. PATENT DOCUMENTS 5,828,357 A * 10/1998 Tamai et al. ..... 345/89

5,886,679 A * 3/1999 Matsuda et al. ..... 345/96

FOREIGN PATENT DOCUMENTS

| | | |
|---|---|---|
| JP | 11-30975 | 2/1999 |
| JP | 11-95729 | 4/1999 |

* cited by examiner

*Primary Examiner*—Richard Hjerpe
*Assistant Examiner*—Mansour M. Said
(74) *Attorney, Agent, or Firm*—Rabin & Berdo, P.C.

(57) ABSTRACT

There is provided a driving circuit of a liquid crystal display device capable of solving a problem of power consumption while solving a problem of time required for charge/discharge of source lines by virtue of shorting by use of precharge. The driving circuit of the liquid crystal display device comprises first shorting means, second shorting means, third shorting means, and fourth shorting means. With the use of the fourth shorting means, in particular, the source lines can be driven starting from a predetermined potential generated by a gradation voltage generation circuit, and a drive start potential is changed from a conventional common electrode potential to potentials generated by the gradation voltage generation circuit, so that power consumption can be effectively reduced (by about 8% on average as compared with the conventional case).

15 Claims, 4 Drawing Sheets

DRIVING CIRCUIT OF DISPLAY DEVICE AND METHOD OF DRIVING SAME

FIELD OF THE INVENTION

The present invention relates to a driving circuit of a liquid crystal display device employing an active matrix panel, and a method of driving the same, and more particularly, to a driving circuit of a liquid crystal display device, having means called precharge for temporarily shorting signal lines with each other, in odd numbered columns and even numbered columns, respectively, for use in driving a TFT (thin film transistor) liquid crystal panel, and a method of driving the same.

BACKGROUND OF THE INVENTION

Conventional precharge is broadly classified into three schemes, that is, 1) shorting of signal lines in odd numbered columns and even numbered columns, adjacent to each other, respectively, 2) shorting of all signal lines, and 3) shorting of all signal lines to a common electrode, and driving capacity and power consumption, required for writing (charge/discharge) of signal voltages to liquid crystal capacitance, is reduced by temporarily executing any of these schemes.

The following Patent Document, namely, JP-A 1999-30975 is cited as an example thereof.

The present technological trend is that the 2-DOT reverse signal line driving method (a driving method whereby signals are reversed for every two horizontal scanning periods) is in the mainstream in order to achieve lower power consumption of a liquid crystal display device. In this case, the precharge executed simply for every two horizontal scanning periods results in deterioration in display quality, so that it is a general practice to execute the precharge for every one horizontal scanning period. The following Patent Document, namely, JP-A 1999-095729 is cited as an example thereof.

Shorting for attaining the conventional precharge as disclosed in JP-A 1999-095729 is important to solve a problem of time required for charge/discharge of source lines. With the shorting by the conventional precharge, however, potentials of the source lines can reach only up to around the potential of the common electrode. Accordingly, in order to implement charge/discharge of the signal lines after the precharge, driving is required for half of charge/discharge that would be required in case the shorting by the precharge is not employed, so that reduction in power consumption is not sufficient in this case.

SUMMARY OF THE INVENTION

To solve the problem described, the invention provides a driving circuit of a liquid crystal display device, having a switching element and liquid crystal capacitance, at respective crossover points between a plurality of gate lines and a plurality of source lines, and the driving circuit comprises a gradation voltage generation circuit for feeding a plurality of voltages higher than a predetermined potential and a plurality of voltages lower than the predetermined potential, a source line output part for sending out outputs of the gradation voltage generation circuit to the respective source lines such that odd numbered columns and even numbered columns of the plurality of the source lines, respectively, have potentials based the predetermined potential, having polarities opposite to each other, first shorting means for shorting the odd numbered columns of the source lines with each other, second shorting means for shorting the even numbered columns of the source lines with each other; third shorting means for shorting the odd numbered columns of the source lines with the even numbered columns of the source lines; and fourth shorting means for shorting a first voltage higher than the predetermined potential, among the plurality of the voltages generated by the gradation voltage generation circuit, and a second voltage lower than the predetermined potential, among the plurality of the voltages generated by the gradation voltage generation circuit, with the odd numbered columns of the source lines and the even numbered columns of the source lines, respectively, after switching over between the first voltage and second voltages in a predetermined cycle.

With the present invention, by use of the first through fourth shorting means, particularly by use of the fourth shorting means, the source lines can be driven starting from the first voltage higher than the predetermined potential, among the plurality of the voltages generated by the gradation voltage generation circuit, or the second voltage lower than the predetermined potential, among the plurality of the voltages generated by the gradation voltage generation circuit. Furthermore, a drive start potential is changed from a conventional common electrode potential to the first voltage higher than the predetermined potential, among the plurality of the voltages generated by the gradation voltage generation circuit, or the second voltage lower than the predetermined potential, among the plurality of the voltages generated by the gradation voltage generation circuit, so that power consumption can be effectively reduced (by about 8% on average as compared with the conventional case).

PREFERRED EMBODIMENTS OF THE INVENTION

Embodiments of the invention are described hereinafter with reference to the accompanying drawings.

First Embodiment

Figure 1:
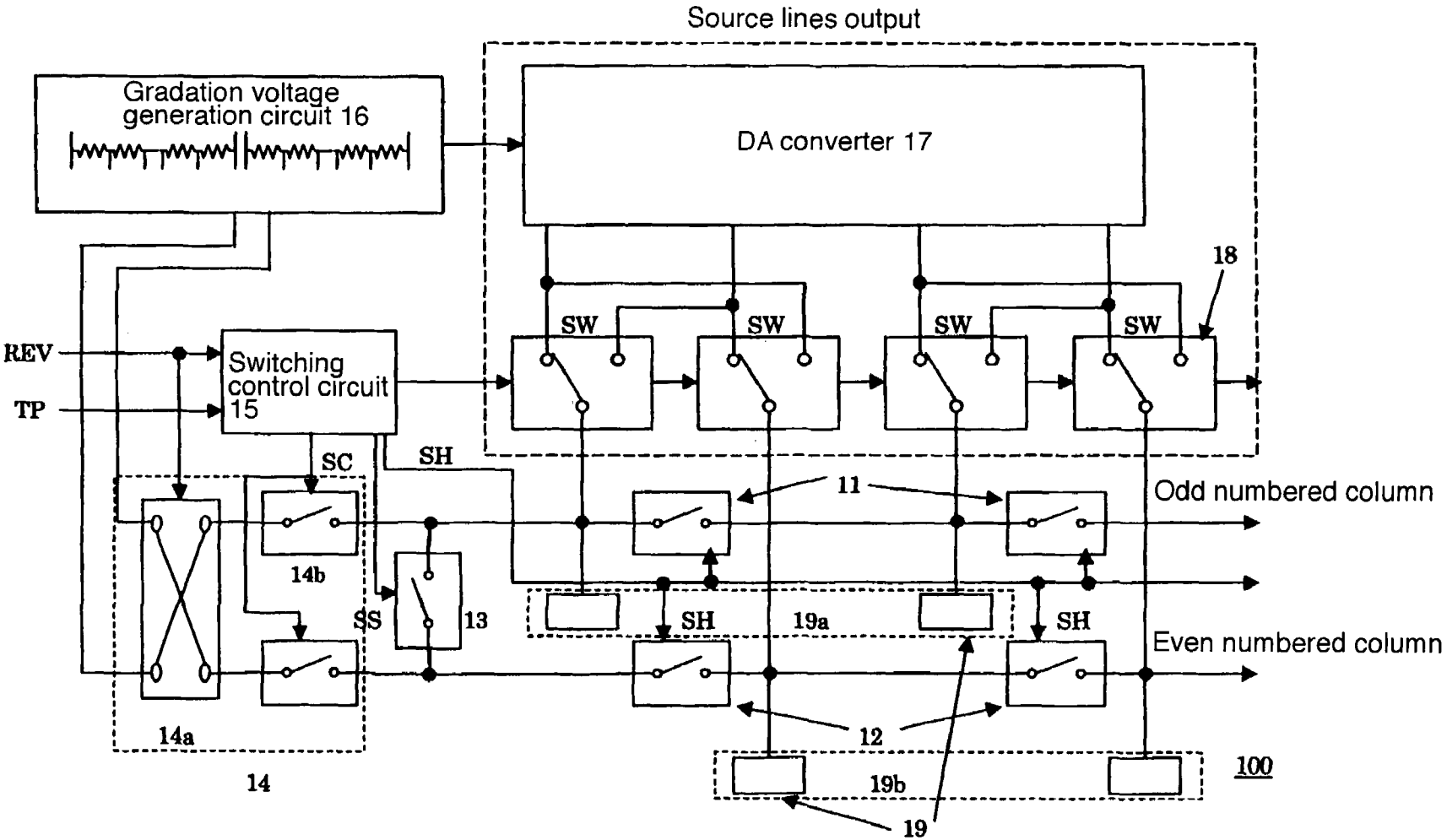
FIG. 1 is a block diagram showing a first embodiment of a driving circuit of a liquid crystal display device according to the invention.
Figure 3:
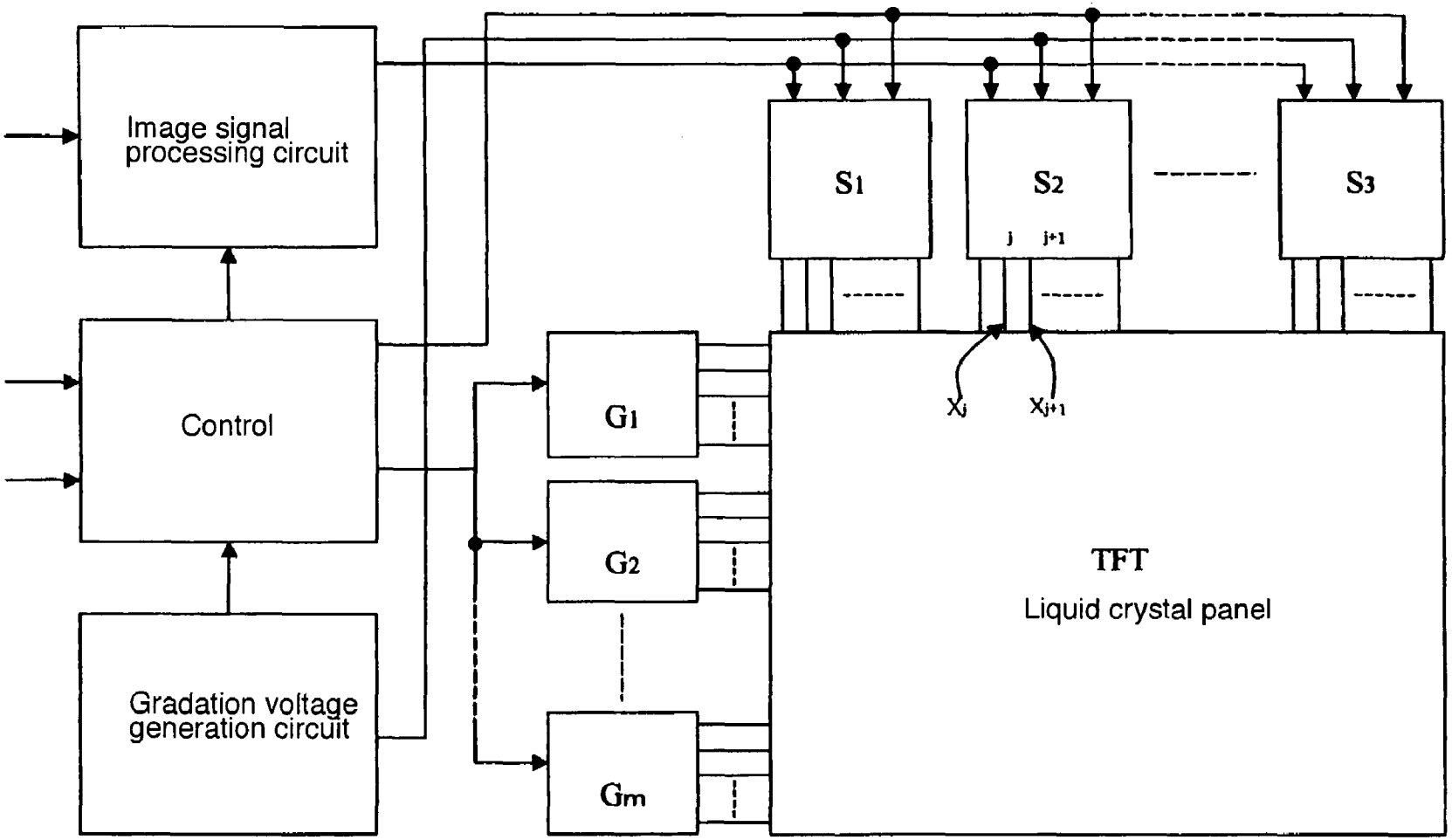
FIG. 3 is a block diagram broadly showing a configuration of an active matrix full-color—TFT-LCD.

FIG. 1 is a block diagram showing a first embodiment of a driving circuit of a liquid crystal display device according to the invention. FIG. 3 is a block diagram broadly showing a configuration of an active matrix full-color—TFT-LCD.

A driving circuit 100 of a liquid crystal display device, comprises first shorting means 11, second shorting means 12, third shorting means 13, fourth shorting means 14, a switching control circuit 15, a gradation voltage generation circuit 16, a DA converter 17, switching circuits 18, and outputs 19. With a liquid crystal panel 300 shown in FIG. 3, source lines Xj, and Xj+1, in j-th column, and (J+1)-th column, adjacent to each other, respectively, are driven by the outputs 19 at two adjacent spots in FIG. 1, respectively.

First, interconnection inside the driving circuit 100 of the liquid crystal display device is described. The outputs 19 are differentiated from each other by connection thereof to either the respective source lines in odd numbered columns or the respective source lines in even numbered columns. An odd numbered column output is denoted by 19*a*, and even numbered column output by 19*b* hereinafter. The first shorting means 11 is provided between the odd numbered column outputs 19*a* adjacent to each other, respectively. By turning the first shorting means 11 ON, potentials of the odd numbered column outputs 19*a* can be averaged. Similarly, the second shorting means 12 is provided between the even numbered column outputs 19*b* adjacent to each other, respectively. By turning the second shorting means 12 ON, potentials of the even numbered column outputs 19*b* can be averaged. The first shorting means 11 and second shorting means 12 are controlled by a third control signal SH outputted from the switching control circuit 15, respectively.

Further, the third shorting means 13 is provided between the odd numbered column outputs 19*a* and the even numbered column outputs 19*b*. By turning the third shorting means 13 ON, the odd numbered column outputs 19*a* and the even numbered column outputs 19*b* can be further averaged. The third shorting means 13 is controlled by a fourth control signal SS outputted from the switching control circuit 15.

The fourth shorting means 14 has a switching part 14*a* and short circuit parts 14*b*. The switching part 14*a* is connected to the gradation voltage generation circuit 16 and the short circuit parts 14*b*. Voltages generated by the gradation voltage generation circuit 16 {in this case, assumed to correspond to plus or minus voltages based on a common electrode voltage Vcom, being a plus potential Vk or minus potential (Vk+1), closest to the common electrode voltage Vcom, by way of example} are outputted. Changeover between the plus potential Vk and the minus potential (Vk+1) is effected by a second control signal REV At the short circuit parts 14*b*, the plus potential Vk or the minus potential (Vk+1), as selected by the switching part 14*a*, is shorted to the odd numbered column outputs 19*a* or the even numbered column outputs 19*b*. The potential of the odd numbered column outputs 19*a* or the even numbered column outputs 19*b* is shifted to the plus potential Vk or the minus potential (Vk+1) as shorted. The short circuit parts 14*b* are controlled by a fifth control signal SC outputted from the switching control circuit 15, respectively.

In response to a signal from an image signal processing circuit 31, the DA converter 17 receives a signal from the gradation voltage generation circuit 16, and delivers an output thereof to the switching circuits 18. Generally, an amplifier (not shown in FIG. 1) interconnects the DA converter 17 and the switching circuits 18, respectively. Further, the DA converter 17 is divided into a part for processing plus potentials, V1 to Vk, and a part for processing minus potentials, (Vk+1) to Vn. Two units of the switching circuits 18 fulfill the function of a pair, and can select a connection with the DA converter 17 depending on whether a subsequent input as required is a plus potential or a minus potential. The switching circuits 18 are controlled by a sixth control signal SW outputted from the switching control circuit 15. As an example of the switching circuits 18, one shown in FIG. 4 in JP-A 1999-095729 can be cited, however, there is no particular limitation thereto provided that an equivalent effect can be obtained. With the present invention, the DA converter 17 combined with the switching circuits 18 into one is called a source line output part.

Now, there is described operation of the driving circuit of the liquid crystal display device according to the first embodiment of the invention.

Figure 2:
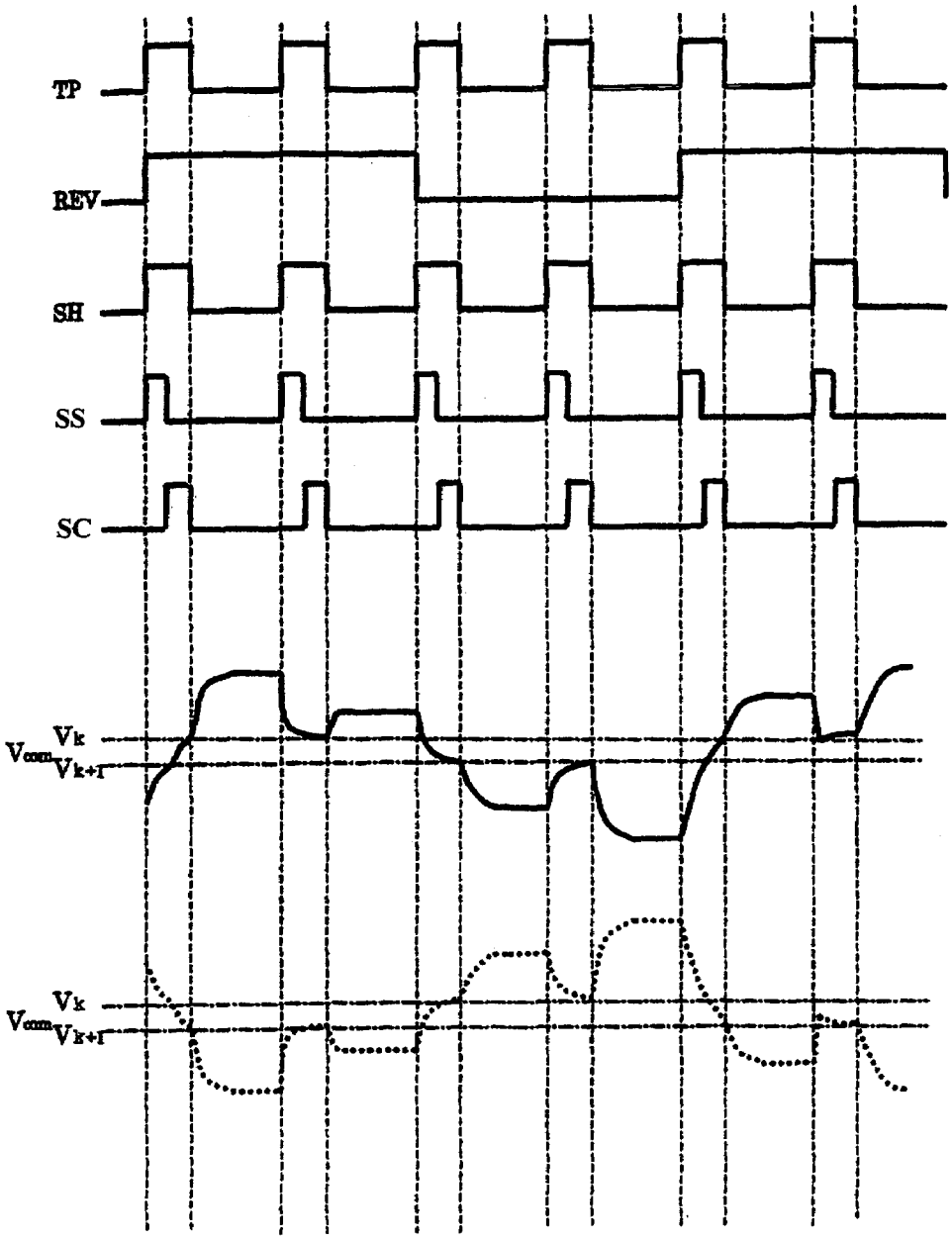
FIG. 2 is an output waveform chart of the driving circuit of the liquid crystal display device according to the first embodiment of the invention.

FIG. 2 is an output waveform chart of the driving circuit of the liquid crystal display device according to the first embodiment of the invention, showing the 2-DOT reverse signal line driving method (the driving method whereby signals are reversed for every two horizontal scanning periods) by way of example. The operation is described hereinafter with reference to FIG. 2.

To start with, a precharge operation when the logical value of the second control signal REV changes (from Low to High) is described. Upon the third control signal SH and fourth control signal SS making a Low to High transition, the first shorting means 11, second shorting means 12, and third shorting means 13 are turned ON. As a result, since all the outputs 19 are shorted, respective potentials of the source lines cancel each other out, so that the respective outputs 19 tend to average out toward around the common electrode voltage Vcom. Further, since the second control signal REV as well has made a Low to High transition, the switching part 14*a* of the fourth shorting means 14 is connected such that the odd numbered column outputs 19*a* can be shorted to the plus potential Vk and the even numbered column outputs 19*b* can be shorted to the minus potential (Vk+1). At this point in time, the respective short circuit parts 14*b* of the fourth shorting means 14 are in the OFF condition, so that the plus potential Vk and the minus potential (Vk+1) are not shorted to the odd numbered column outputs 19*a* and the even numbered column outputs 19*b*, respectively.

Subsequently, the fourth control signal SS makes a High to Low transition and the fifth control signal SC makes a Low to High transition, whereupon the third shorting means 13 are turned OFF while the first shorting means 11 are turned ON, thereby causing all the odd numbered column outputs 19*a* to be shorted to the plus potential Vk, so that all the odd numbered column outputs 19*a* are shifted to a potential around the plus potential Vk. Further, as a result of the second shorting means 12 being turned ON, the even numbered column outputs 19*b* are shorted to the minus potential (Vk+1), so that the even numbered column outputs 19*b* are shifted to a potential around the minus potential (Vk+1).

After completion of the precharge, the fifth control signal SC and the third control signal SH make a High to Low transition, whereupon the first shorting means 11, the second shorting means 12, and the short circuit parts 14*b* of the fourth shorting means 14 are turned OFF, thereby causing all the outputs 19 to be separated from the gradation voltage generation circuit 16 {the plus potential Vk or the minus potential (Vk+1)}. Upon completion of the separation of all the outputs 19 from the gradation voltage generation circuit 16, respective gradation voltages V1 to Vn, generated by the gradation voltage generation circuit 16, are written to the respective outputs 19 via the DA converter 17.

Now, the precharge operation when the logical value of the second control signal REV does not change (from Low to Low or from High to High) is described. The third control signal SH, fourth control signal SS, and fifth control signal SC perform the same actions as those for the case where the logical value of the second control signal REV changes, respectively, so that the respective operations of the first shorting means 11, second shorting means 12, third shorting means 13, and the short circuit parts 14*b* of the fourth shorting means 14 are the same as those for the case where the logical value of the second control signal REV changes from Low to High. In the case of the second control signal REV making no transition form High to High, the switching part 14*a* of the fourth shorting means 14 is connected such that the odd numbered column outputs 19*a* can be shorted to the plus potential Vk and the even numbered column outputs 19*b* can be shorted to the minus potential (Vk+1) as with the case where the second control signal REV makes the Low to High transition. Further, in the case of the second control signal REV making no transition form Low to Low, the switching part 14*a* of the fourth shorting means 14 is connected such that the odd numbered column outputs 19*a* can be shorted to the minus potential (Vk+1) and the even numbered column outputs 19*b* can be shorted to the plus potential Vk, which is the reverse of the case where the second control signal REV makes the Low to High transition.

To compare the operation of the present embodiment with that for the conventional case, when the logical value of the second control signal REV does not change (for example, from High to High), the respective outputs 19 used to be shorted to the common electrode voltage Vcom in the conventional case, and respective potentials of the outputs 19 used to be written from around the common electrode voltage Vcom. With the present embodiment, when the logical value of the second control signal REV does not change (for example, from High to High), the odd numbered column outputs 19*a* are differentiated from the even numbered column outputs 19*b*, and the plus potential Vk is shorted to the odd numbered column outputs 19*a* while the minus potential (Vk+1) is shorted to the even numbered column outputs 19*b*. Thereafter, the odd numbered column outputs 19*a* start writing from the plus potential Vk, and the even numbered column outputs 19*b* start writing from the minus potential (Vk+1). Even though power used to be consumed by the odd numbered column outputs 19*a* during a period from the common electrode voltage Vcom to the plus potential Vk in the conventional case, no power consumption occurs during this period in the case of the present embodiment.

Similarly, when the logical value of the second control signal REV changes (for example, from High to Low), the respective outputs 19 used to be shorted to the common electrode voltage Vcom in the conventional case, and respective potentials of the outputs 19 used to be written from around the common electrode voltage Vcom. With the present embodiment, the odd numbered column outputs 19*a* are differentiated from the even numbered column outputs 19*b*, and the minus potential (Vk+1) is shorted to the odd numbered column outputs 19*a* while the plus potential Vk is shorted to the even numbered column outputs 19*b*. Thereafter, the odd numbered column outputs 19*a* start writing from the minus potential (Vk+1), and the even numbered column outputs 19*b* start writing from the plus potential Vk. In the conventional case, power used to be consumed by the odd numbered column outputs 19*a* during a period from the common electrode voltage Vcom to the minus potential (Vk+1), and at the same, power used to be consumed by the even numbered column outputs 19*b* during the period from the common electrode voltage Vcom to the plus potential Vk. With the present embodiment, however, no power consumption occurs during these periods in the case of the present embodiment.

Under the driving condition of a liquid crystal display device, a potential difference between the plus potential Vk and the minus potential (Vk+1) is 1.6V, and a voltage value is commonly set in this neighborhood. In the case of a 10V driven liquid crystal display device, it is possible to achieve reduction in power consumption by about 8%.

Second Embodiment

Figure 4:
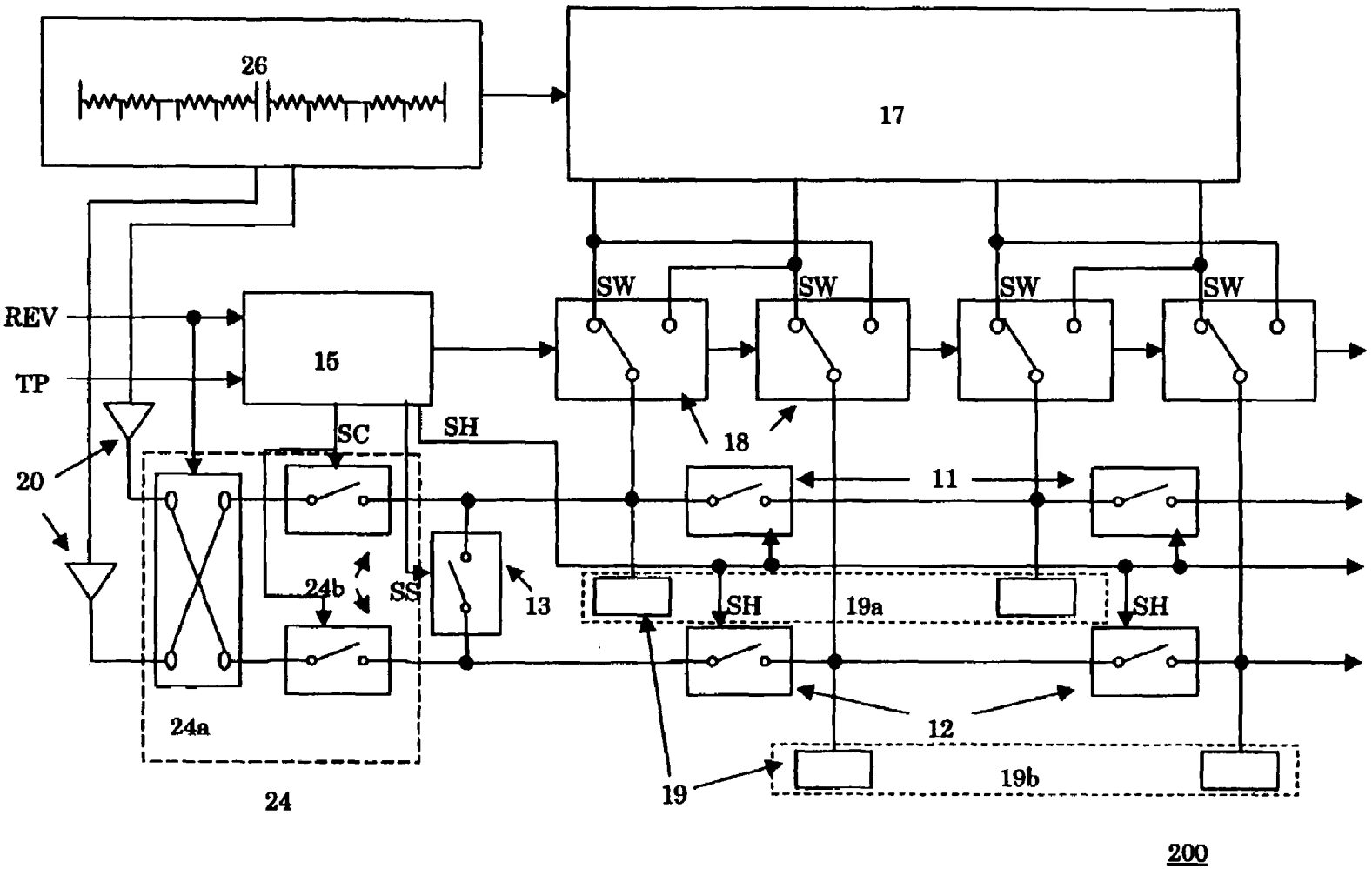
FIG. 4 is a block diagram showing a second embodiment of a driving circuit of a liquid crystal display device according to the invention.

Now, there is described a second embodiment of the invention. FIG. 4 is a block diagram showing the second embodiment of a driving circuit of a liquid crystal display device according to the invention. In describing the driving circuit of the liquid crystal display device, and a method of driving the same, according to the present embodiment, constituents corresponding to those in FIG. 1 are denoted by like reference numerals.

A driving circuit 200 of a liquid crystal display device, comprises a first shorting means 11, a second shorting means 12, a third shorting means 13, a fourth shorting means 24, a switching control circuit 15, a gradation voltage generation circuit 26, a DA converter 17, switching circuits, 18, outputs 19, and feed voltage adjusting means 20. With the liquid crystal panel 300 shown in FIG. 3, source lines Xj, and Xj+1, in j-th column and (J+1)-th column, adjacent to each other, respectively, are driven by the outputs 19 at two adjacent spots in FIG. 1, respectively.

As for interconnection inside the driving circuit 200 of the liquid crystal display device, constituents corresponding to those denoted by like reference numerals in FIG. 1 are connected in like manners. Herein, there will be described only points of alteration. The fourth shorting means 24 has a switching part 24*a* and short circuit parts 24*b*. The switching part 24*a* is connected to voltages generated by the gradation voltage generation circuit 26 {in this case, assumed to correspond to plus or minus voltages based on a common electrode voltage Vcom, being a plus potential Vk or minus potential (Vk+1), closest to the common electrode voltage Vcom, by way of example} and the short circuit parts 24*b*. Changeover between the plus potential Vk and minus potential (Vk+1) is effected by a second control signal REV At the short circuit parts 24*b*, the plus potential Vk or the minus potential (Vk+1), as selected by the switching part 24*a*, is shorted to odd numbered column outputs 19*a* or even numbered column outputs 19*b*. The potential of the odd numbered column outputs 19*a* or the even numbered column outputs 19*b* is shifted to the plus potential Vk or the minus potential (Vk+1) as shorted. The short circuit parts 24*b* are controlled by a fifth control signal SC outputted from the switching control circuit 15, respectively.

The feed voltage adjusting means 20 interconnect the gradation voltage generation circuit 26 and the switching part 24*a* of the fourth shorting means 24.

The operation and effect of the second embodiment of the invention are described hereinafter.

The operation of the second embodiment of the invention is basically the same as that for the first embodiment of the invention. However, the second embodiment differs in its effect from the first embodiment with respect to the following points. At the time of the conventional precharge operation, there used to occur outflow of current, although minute in amperage, from the gradation voltage generation circuit 16 into the first shorting means 11, second shorting means 12, third shorting means 13, and fourth shorting means 24, thereby causing an error to occur to the gradation voltage generation circuit 16 for generating an analog voltage with high precision. In theory, the voltage ought to revert to a correct potential after the precharge, but in case the voltage fails to revert in full before writing of signals is started, there will arise the risk of an erroneous voltage being delivered. With the second embodiment of the invention, however, the feed voltage adjusting means 20 interconnect the gradation voltage generation circuit 26 and the switching part 24*a* of the fourth shorting means 24, so that current is fed from a power source other than the gradation voltage generation circuit 26, thereby enabling current feed capacity to be enhanced. Further, because outflow of current from the gradation voltage generation circuit 26 can be prevented, it is possible to prevent occurrence of an error in voltage accuracy of the gradation voltage generation circuit 26.

What is claimed is:

1. A driving circuit of a liquid crystal display device, having a switching element and liquid crystal capacitance, at respective crossover points between a plurality of gate lines and a plurality of source lines, said driving circuit comprising:

a gradation voltage generation circuit for feeding a plurality of voltages higher than a predetermined potential and a plurality of voltages lower than the predetermined potential;

a source line output part for sending out outputs of the gradation voltage generation circuit to the respective source lines such that odd numbered columns and even numbered columns of the plurality of the source lines, respectively, have potentials based the predetermined potential, having polarities opposite to each other;

first shorting means for shorting the odd numbered columns of the source lines with each other;

second shorting means for shorting the even numbered columns of the source lines with each other;

third shorting means for shorting the odd numbered columns of the source lines with the even numbered columns of the source lines; and fourth shorting means for shorting a first voltage higher than the predetermined potential, among the plurality of the voltages generated by the gradation voltage generation circuit, and a second voltage lower than the predetermined potential, among the plurality of the voltages generated by the gradation voltage generation circuit, with the odd numbered columns of the source lines and the even numbered columns of the source lines, respectively, after switching over between the first voltage and second voltages in a predetermined cycle.

2. A driving circuit of a liquid crystal display device, according to claim 1, wherein the switching over in the predetermined cycle means that polarities of the source lines in the odd numbered columns and the even numbered columns, respectively, are reversed once every plural times.

3. A driving circuit of a liquid crystal display device, according to claim 1, wherein at the outset of writing to the liquid crystal capacitance, the fourth shorting means separate outputs of the source line output part from the source lines, and depending on a next shifting polarity of the source lines, cause the voltages generated by the gradation voltage generation circuit, having the same polarity as the next shifting polarity, to be shorted.

4. A driving circuit of a liquid crystal display device, according to claims 1, wherein if the next shifting polarity of the source lines is opposite to a preceding polarity, shorting is executed in two stages by use of the third shorting means and fourth shorting means.

5. A driving circuit of a liquid crystal display device, according to claim 4, wherein the shorting in the two stages is implemented first by shorting with the third shorting means, and subsequently, by shorting with the fourth shorting means.

6. A driving circuit of a liquid crystal display device, according to claim 1, wherein feed voltage adjusting means are provided between the gradation voltage generation circuit and the fourth shorting means.

7. A driving circuit of a liquid crystal display device, comprising:

a switching element and liquid crystal capacitance, provided at respective crossover points between a plurality of gate lines and a plurality of source lines;

a gradation voltage generation circuit for feeding a plurality of voltages higher than a predetermined potential and a plurality of voltages lower than the predetermined potential; and a source line output part for sending out outputs of the gradation voltage generation circuit to the source lines such that the source lines adjacent to each other have potentials based the predetermined potential, having polarities opposite to each other, wherein the source lines are shorted to a desired voltage selected from among the voltages generated by the gradation voltage generation circuit, and subsequently, the polarity of voltages of the source lines, at the predetermined potential, is enabled to shift to the same polarity as that of the desired voltage selected.

8. A driving circuit of a liquid crystal display device, according to claim 7, wherein the predetermined potential is a common electrode potential.

9. A driving circuit of a liquid crystal display device, according to claim 7, wherein the desired voltage selected is the voltage generated by the gradation voltage generation circuit, having the same polarity as a next shifting voltage polarity of the source lines.

10. A driving circuit of a liquid crystal display device, according to claim 7, wherein the desired voltage selected is a voltage among the voltages generated by the gradation voltage generation circuit, based on the predetermined potential, at either of two potentials having polarities opposite to each other, and closest to the predetermined potential.

11. A method of driving a driving circuit of a liquid crystal display device, having a switching element and liquid crystal capacitance, at respective crossover points between a plurality of gate lines and a plurality of source lines, for outputting voltages generated by a gradation voltage generation circuit to the source lines through the intermediary of a source line output part, comprising the steps of:

separating outputs of the source line output part from the source lines at the outset of writing to the liquid crystal capacitance; and causing desired voltages generated by the gradation voltage generation circuit to be shorted to the source lines after shorting the source lines with each other;

wherein writing to the liquid crystal capacitance is subsequently executed by connecting the outputs of the source line output part to the source lines.

12. A method of driving a driving circuit of a liquid crystal display device, according to claim 11, wherein the shorting the source lines with each other comprises three varieties including shorting of odd numbered columns of the source lines with each other, shorting of even numbered columns of the source lines with each other, and shorting of all the source lines in the odd numbered columns with all the source lines in the even numbered columns.

13. A method of driving a driving circuit of a liquid crystal display device, according to claim 11, wherein the gradation voltage generation circuit generates the voltages based on a common electrode potential, having either positive polarity or negative polarity, and the desired voltages generated by the gradation voltage generation circuit are either a voltage having the positive polarity, and closest to the common electrode potential or a voltage having the negative polarity, and closest to the common electrode potential.

14. A method of driving a driving circuit of a liquid crystal display device, according to claim 13, wherein for shorting of the desired voltages generated by the gradation voltage generation circuit to the source lines, use is made of the voltage having the positive polarity, and closest to the common electrode potential or the voltage having the negative polarity, and closest to the common electrode potential depending on the next shifting polarity of the source lines.

15. A method of driving a driving circuit of a liquid crystal display device, according to claim 14, wherein use is made of the desired voltage selected voltage generated by the gradation voltage generation circuit, having the same polarity as the next shifting polarity of the source lines.

* * * * *